US010971854B2

(12) United States Patent
Tanaka et al.

(10) Patent No.: US 10,971,854 B2
(45) Date of Patent: Apr. 6, 2021

(54) SHIELDED CONNECTOR

(71) Applicant: Yazaki Corporation, Tokyo (JP)

(72) Inventors: Yasuhiro Tanaka, Shizuoka (JP); Noboru Hayasaka, Shizuoka (JP); Shotaro Shibata, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/551,643

(22) Filed: Aug. 26, 2019

(65) Prior Publication Data

US 2020/0076116 A1 Mar. 5, 2020

(30) Foreign Application Priority Data

Aug. 29, 2018 (JP) ..... JP2018-160041

(51) Int. Cl.

| | |
|---|---|
| ***H01R 12/00*** | (2006.01) |
| ***H01R 13/52*** | (2006.01) |
| ***H01R 13/73*** | (2006.01) |
| ***H01R 13/502*** | (2006.01) |

(52) U.S. Cl.

CPC ..... *H01R 13/5202* (2013.01); *H01R 13/502* (2013.01); *H01R 13/73* (2013.01)

(58) Field of Classification Search

CPC ..... H01R 13/6658; H01R 2201/26; H01R 13/53; H01R 13/743; H01R 23/7073

USPC ..... 439/76.1, 76.2, 34, 475, 557, 660

See application file for complete search history.

(56) References Cited

U.S. PATENT DOCUMENTS

| | | | | |
|---|---|---|---|---|
| 4,684,190 | A * | 8/1987 | Tsuji et al. ..... | H01R 13/5208 439/587 |
| 5,947,766 | A * | 9/1999 | Clark et al. ..... | H01R 13/5202 439/559 |
| 6,702,611 | B1 | 3/2004 | Miyazaki et al. | |
| 2012/0258635 | A1 * | 10/2012 | Osawa ..... | H01R 13/50 439/660 |

FOREIGN PATENT DOCUMENTS

| | | | |
|---|---|---|---|
| JP | H6-58560 | U | 8/1994 |
| JP | 2001-60481 | A | 3/2001 |
| JP | 2010-140873 | A | 6/2010 |

* cited by examiner

*Primary Examiner* — Phuong Chi Thi Nguyen
(74) *Attorney, Agent, or Firm* — Kenealy Vaidya LLP

(57) ABSTRACT

A shielded connector includes a shielding shell, a connector housing, and an annular sealing member. The shielding shell has a tube portion and a flange portion formed at an end of the tube portion. The flange portion is fastened to a wall portion having a hole of a target object to which the shielded connector is fastened. The connector housing is covered with the tube portion and has an end portion projecting in an axial direction beyond the flange portion and inserted in the hole. The sealing member is sandwiched between the flange portion and the wall portion. The sealing member closely contacts with the wall portion by being compressed toward the wall portion and closely contacts with an outer surface of the connector housing by being compressed toward the outer surface.

1 Claim, 5 Drawing Sheets

SHIELDED CONNECTOR

CROSS-REFERENCE TO RELATED APPLICATION(S)

The present application claims priority to and incorporates by reference the entire contents of Japanese Patent Application No. 2018-160041 filed in Japan on Aug. 29, 2018.

BACKGROUND OF THE INVENTION

1. Field of the Invention

The present invention relates to a shielded connector.

2. Description of the Related Art

Shielded connectors including a connector housing and a shielding shell accommodating the connector housing are known. The connector housing is attached to a conductive housing of an electric device and the shielding shell is electrically connected to the conductive housing so that the shielded connectors will be connected to ground. Some shielded connectors have a waterproof structure to prevent liquids from entering the housing through a gap between, for example, the housing and the shielding shell or the connector housing and the shielding shell.

For example, Japanese Patent Application Laid-open No. 2010-140873 discloses a waterproof structure of a device connector including a housing, a flange portion, an elastic sealing member, and a conductive metal shielding shell. The housing has a front-end portion inserted in a mounting hole and exposing a conductive metal terminal. The flange portion is integrally and annularly formed on an outer circumferential surface of the front-end portion of the housing. The flange portion has a continuous annular groove on a surface facing a metal plate surface of a casing surrounding the mounting hole. The groove extends along the outer circumferential surface of the housing. The elastic sealing member is fitted in the groove of the flange portion. The shielding shell is fastened to the metal plate of the casing and pushes the flange portion toward the metal plate to compress the elastic sealing member between the flange portion and the metal plate of the casing. The technique disclosed in Japanese Patent Application Laid-open No. 2010-140873 can provide waterproofness with a simple structure.

The industry has been demanding a shielded connector having a structure that can reduce a size of the shielded connector while preventing liquids from entering from outside in a gap between a hole of a target object to which the shielded connector is fastened and an end portion of a connector housing inserted in the hole.

SUMMARY OF THE INVENTION

An object of the present invention is to provide a shielded connector that can reduce a size of the shielded connector while preventing liquids from entering a gap between a hole of a target object to which the shielded connector is fastened and an end portion of the connector housing inserted in the hole.

In order to achieve the above mentioned object, a shielded connector according to one aspect of the present invention includes a shielding shell having a tube portion and a flange portion formed at an end of the tube portion, the flange portion being fastened to a wall portion of a target object to which the shielded connector is fastened, the wall portion having a hole; a connector housing covered with the tube portion, the connector housing having an end portion projecting in an axial direction beyond the flange portion, the end portion being inserted in the hole; and an annular sealing member sandwiched between the flange portion and the wall portion, wherein the sealing member closely contacts with the wall portion by being compressed toward the wall portion and closely contacts with an outer surface of the connector housing by being compressed toward the outer surface.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENT

The following describes a shielded connector according to an embodiment of the present invention with reference to the accompanying drawings. The embodiment is not intended to limit the scope of the present invention. Components described in the embodiment below include components that can be easily thought of by the skilled person, or components that are substantially the same.

EMBODIMENT

Figure 1:
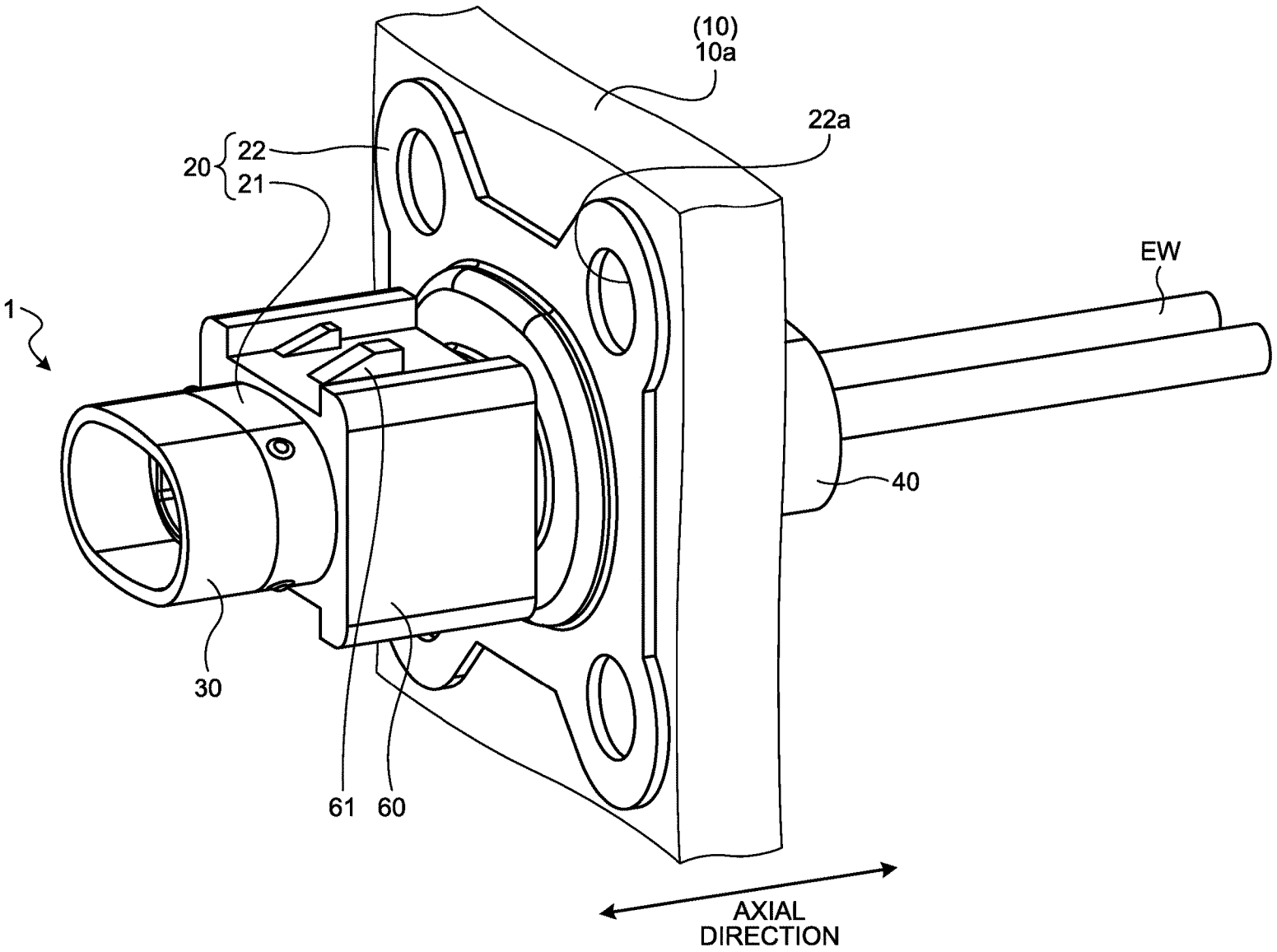
FIG. 1 is a perspective view of a shielded connector according to an embodiment of the present invention.
Figure 2:
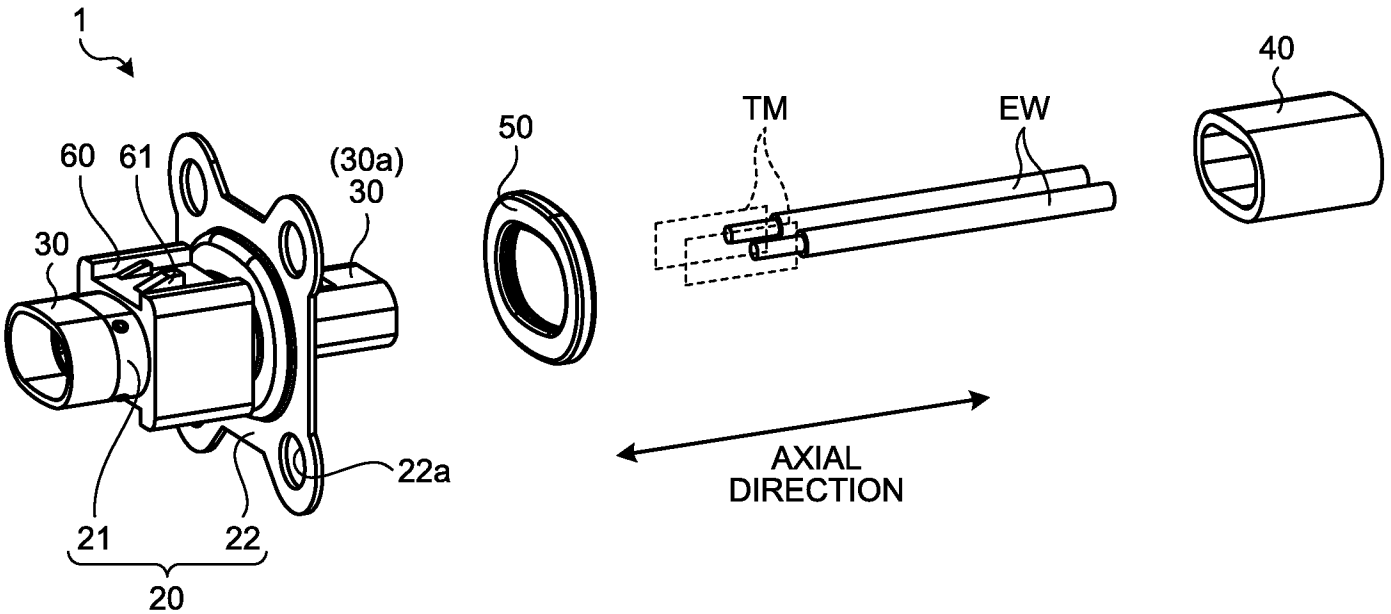
FIG. 2 is an exploded perspective view of the shielded connector according to the embodiment.
Figure 3:
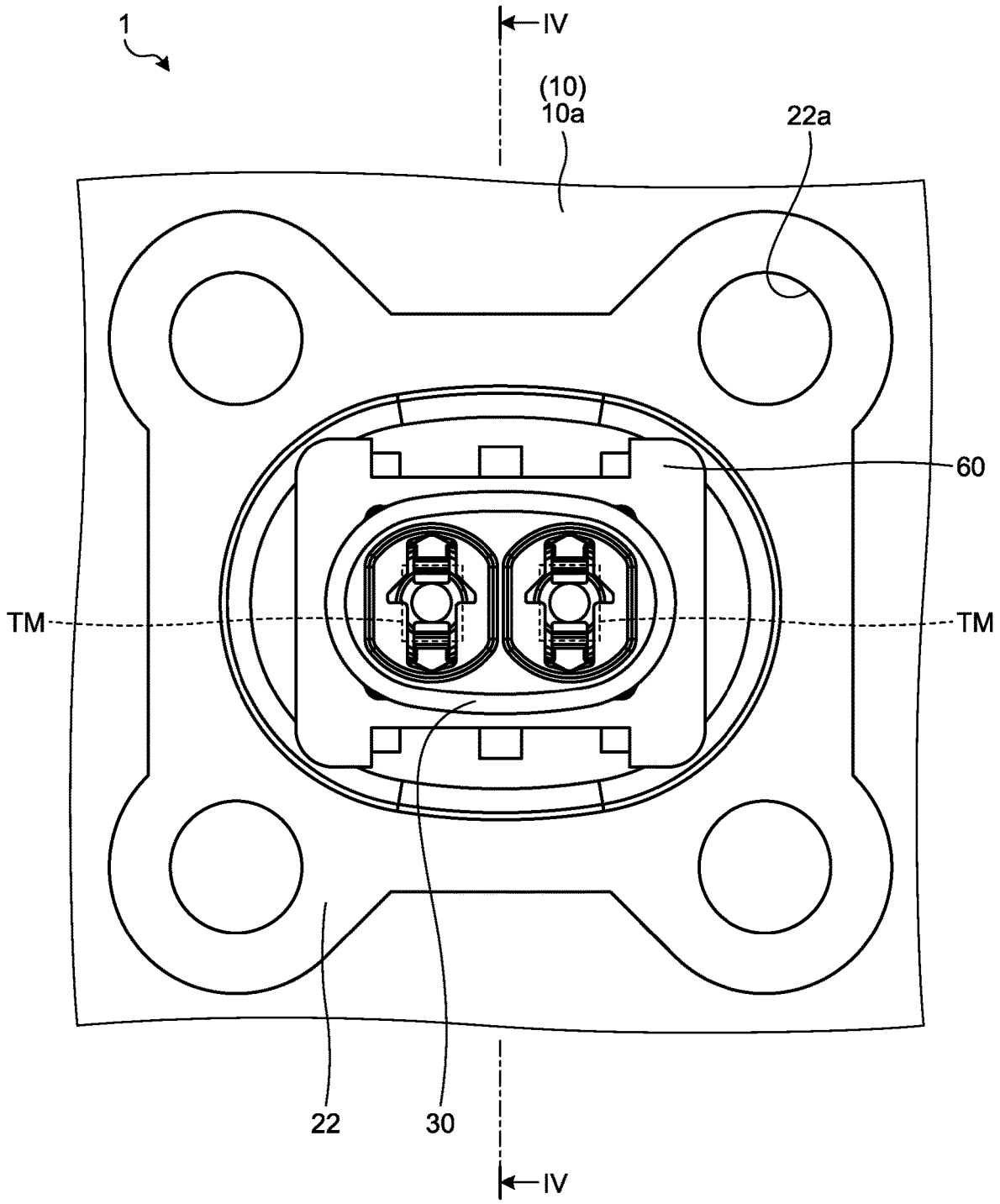
FIG. 3 is a front view of the shielded connector according to the embodiment.
Figure 4:
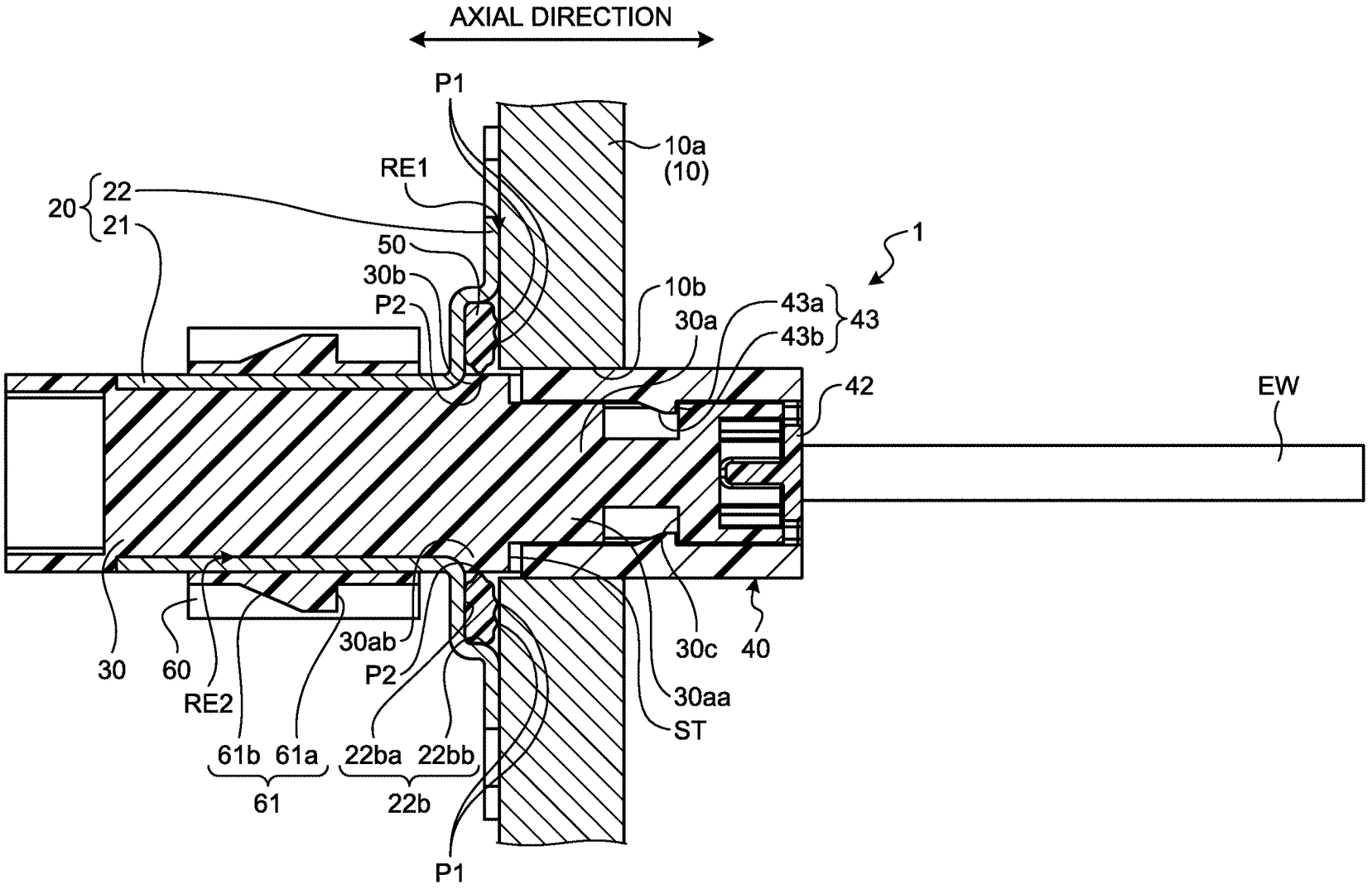
FIG. 4 is a sectional view of the shielded connector according to the embodiment.
Figure 5:
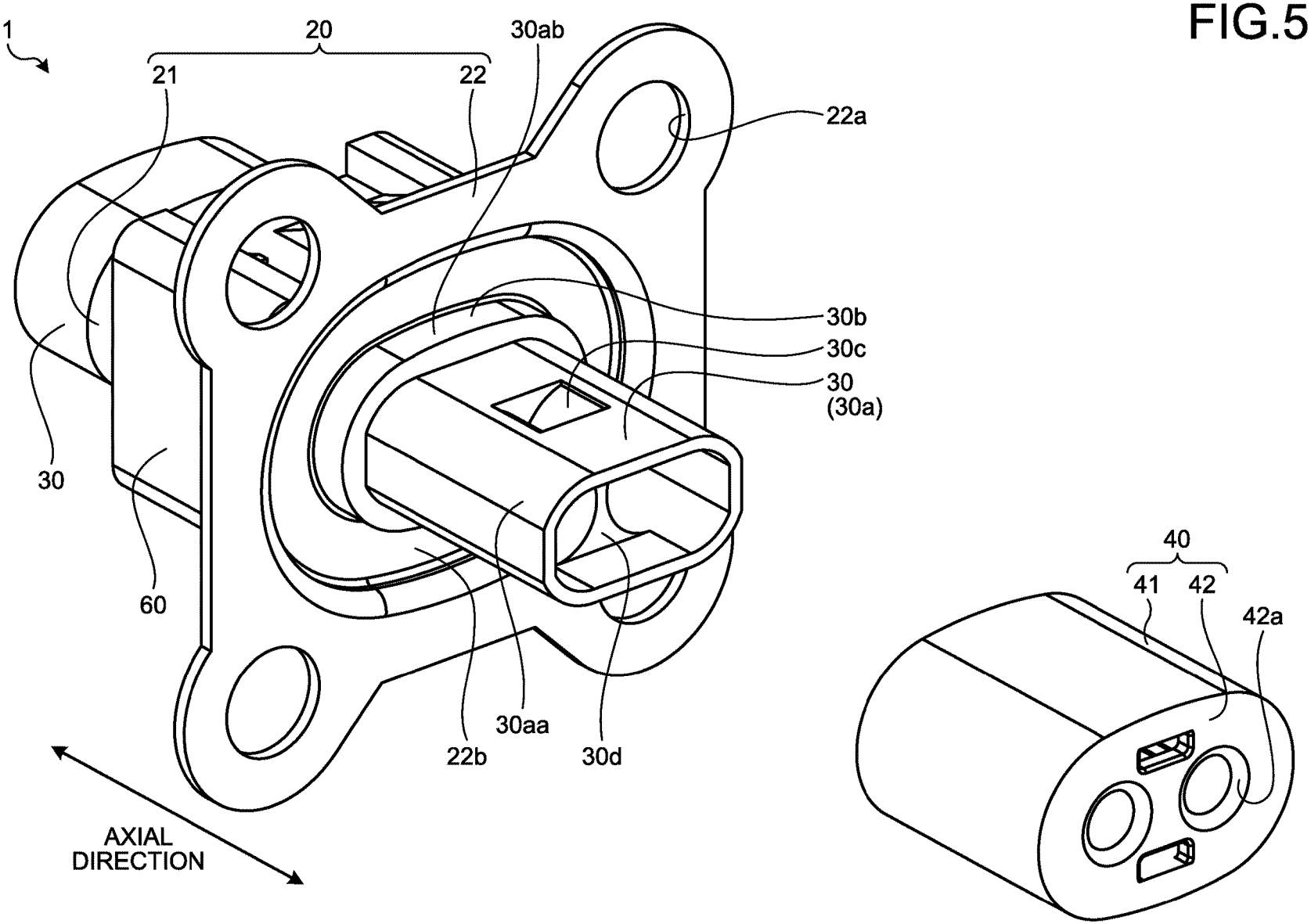
FIG. 5 is a perspective view of a connector housing and a shielding shell according to the embodiment.

An embodiment of the present invention will be described with reference to FIGS. 1 to 5. FIG. 1 is a perspective view of a shielded connector according to the embodiment. FIG. 2 is an exploded perspective view of the shielded connector according to the embodiment. FIG. 3 is a front view of the shielded connector according to the embodiment. FIG. 4 is a sectional view of the shielded connector according to the embodiment. FIG. 5 is a perspective view of a connector housing and a shielding shell according to the embodiment. FIG. 4 is a sectional view of the shielded connector taken at line IV-IV in FIG. 3.

The shielded connector according to the embodiment is used in a vehicle such as an automobile to electrically connect electric devices in the vehicle. As illustrated in FIG. 1, this shielded connector 1 according to the embodiment is fastened to a wall portion 10*a* of a housing 10 that is a target object to which the shielded connector 1 is fastened. The wall portion 10*a* is a wall portion of a housing of an electric device such as an inverter or an electric junction box. The housing 10 is a conductive housing. The housing 10 is, for example, a metal housing. The housing 10 in the drawings is represented only by the wall portion 10*a* of the housing 10.

As illustrated in FIG. 2, the shielded connector 1 according to the embodiment includes a shielding shell 20, a connector housing 30, a rear holder 40, a sealing member 50, and an outer housing 60.

The shielding shell 20 has a tube-shaped tube portion 21 and a flange portion 22 formed at an end of the tube portion 21. The tube portion 21 according to the embodiment has an oval tube shape and extends in an axial direction. The flange portion 22 projects in a direction (radial direction) perpendicular to the axial direction of the tube portion 21. The flange portion 22 is a plate-like member having a generally rectangular shape. As illustrated in FIG. 3, the flange portion 22 according to the embodiment has insertion holes 22*a* at every corner when seen in the axial direction of the tube portion 21. The insertion holes 22*a* are used in fastening the shielded connector 1 to the wall portion 10*a*. Fastening members (not illustrated) such as bolts are inserted in the insertion holes 22*a*. The shielding shell 20 is made of a conductive metal material.

The connector housing 30 is a tube-shaped insulating member. The connector housing 30 houses electric wires EW and terminal fittings TM connected to an end of the electric wires EW. The connector housing 30 according to the embodiment has an oval tube shape. The connector housing 30 houses two electric wires EW connected with two terminal fittings TM. When the oval tube connector housing 30 is seen from the opening in which the electric wires EW are inserted, the electric wires EW connected with the terminal fittings TM are arranged side by side along the longer diameter of the connector housing 30. A partition 30*d* is provided inside the connector housing 30 according to the embodiment to separate the space in the connector housing 30 into two. The partition 30*d* separates the space inside the connector housing 30 into two in the direction of the longer diameter when the oval tube connector housing 30 is seen from the opening. One of the two electric wires EW is disposed in one of the separated spaces and the other electric wire EW is disposed in the other space.

As illustrated in FIG. 4, the connector housing 30 is covered with the tube portion 21. The connector housing 30 has an end portion 30*a* protruding beyond the flange portion 22 in the axial direction. The wall portion 10*a* of the housing 10 has a hole 10*b*. The end portion 30*a* is inserted in the hole 10*b*. The connector housing 30 is made of an insulating synthetic resin.

The rear holder 40 is a member for holding the electric wires EW. The rear holder 40 is formed in conformance to the external shape of the connector housing 30. The rear holder 40 is connected to the connector housing 30 by covering the connector housing 30 from outside. In the present embodiment, a portion 30*aa* of the end portion 30*a* inserted in the hole 10*b* of the wall portion 10*a* is smaller than a portion 30*ab* of the connector housing 30 projecting from the wall portion 10*a*. The portion 30*ab* is disposed close to the shielding shell 20 relative to the wall portion 10*a*. The end portion 30*a* has a step portion ST between the portion 30*ab* protruding from the wall portion 10*a* and the portion 30*aa* inserted in the hole 10*b*. The rear holder 40 is attached to the portion 30*aa* inserted in the hole 10*b* and covers the portion 30*aa* to the step portion ST.

As illustrated in FIG. 5, the rear holder 40 according to the embodiment has a tubular wall portion 41 and a wall portion 42. The tubular wall portion 41 has an oval tube shape and has two openings, one of which is closed by the wall portion 42. The wall portion 42 has insertion holes 42*a* in which the electric wires EW are inserted. The wall portion 42 has two insertion holes 42*a* and the two electric wires EW are inserted in the respective insertion holes 42*a*. The rear holder 40 is attached such that the tubular wall portion 41 covers part of the end portion 30*a* inserted in the hole 10*b*. The rear holder 40 is made of synthetic resin.

The connector housing 30 has indented engaging parts 30*c* on an outer surface 30*b* of the end portion 30*a*. As illustrated in FIG. 4, locking hooks 43 are formed on an inner wall portion of the rear holder 40. Each locking hook 43 has a locking surface 43*a* and a inclined surface 43*b*. The locking surface 43*a* faces the wall portion 42. The inclined surface 43*b* is located away from the wall portion 42 relative to the locking surface 43*a*. The inclined surface 43*b* inclines from the inner wall portion of the rear holder 40 to an edge of the locking surface 43*a*. When the rear holder 40 is attached to the end portion 30*a*, the inclined surface 43*b* passes over the end portion 30*a* and the locking hook 43 reaches the engaging part 30*c*. The locking hook 43 mates with the engaging part 30*c*. The locking surface 43*a* abuts the engaging part 30*c*, thereby preventing disengagement of the rear holder 40 from the end portion 30*a*. An end of the rear holder 40 opposite to the wall portion 42 is disposed between the wall portion 10*a* and the end portion 30*a*.

As illustrated in FIG. 2, the sealing member 50 is an annular member. As illustrated in FIG. 4, the sealing member 50 is sandwiched between the flange portion 22 and the wall portion 10*a* with the end portion 30*a* of the connector housing 30 inserted in the hole 10*b*. The sealing member 50 is made of, for example, resin to have elastic properties. The sealing member 50 according to the embodiment is an annular packing. As illustrated in FIG. 5, the flange portion 22 according to the embodiment has an annular recess 22*b* indented away from the wall portion 10*a*. The recess 22*b* is formed so as to surround the outer surface 30*b* of the connector housing 30. As illustrated in FIG. 4, the sealing member 50 is disposed in the recess 22*b*.

The recess 22*b* according to the embodiment has a first facing wall surface 22*ba* and a second facing wall surface 22*bb*. The first facing wall surface 22*ba* of the recess 22*b* faces the wall portion 10*a*. The first facing wall surface 22*ba* according to the embodiment is a flat surface parallel to the wall portion 10*a*. As illustrated in FIG. 5, the first facing wall surface 22*ba* is an annular surface disposed around the outer surface 30*b* when seen from the end portion 30*a*. The second facing wall surface 22*bb* of the recess 22*b* faces the outer surface 30*b* of the connector housing 30. The second facing wall surface 22*bb* is perpendicular to the first facing wall surface 22*ba* and extends from the periphery of the annular first facing wall surface 22*ba* toward the wall portion 10*a*.

The sealing member 50 of the shielded connector 1 attached to the wall portion 10*a* is disposed in an annular space defined by the end portion 30*a* of the connector housing 30, the first facing wall surface 22*ba*, the second facing wall surface 22*bb*, and the wall portion 10*a*. When the shielded connector 1 is mounted to the wall portion 10*a*, the sealing member 50 is compressed by the first facing wall surface 22*ba* toward the wall portion 10*a* and closely contacts with the wall portion 10*a*. The sealing member 50 providing a seal on the wall portion 10*a* prevents liquids from entering the housing 10 through a gap between, for example, the flange portion 22 and the wall portion 10*a*.

When the sealing member 50 is not sandwiched between the flange portion 22 and the wall portion 10*a*, the thickness of the sealing member 50 in the axial direction is slightly larger than the distance between the first facing wall surface 22*ba* and the wall portion 10*a* with the flange portion 22 being fastened to the wall portion 10*a*. When the sealing member 50 is not sandwiched between the flange portion 22 and the wall portion 10*a*, the thickness of the sealing member 50 in a direction orthogonal to the axial direction is substantially equal to or slightly smaller than the distance between the second facing wall surface 22*bb* and the outer surface 30*b*. When the flange portion 22 is fastened to the wall portion 10*a*, the sealing member 50 is compressed by the first facing wall surface 22*ba* toward the wall portion 10*a* and housed between the first facing wall surface 22*ba* and the wall portion 10*a*. The compressed sealing member 50 bulges in a direction from the second facing wall surface 22*bb* toward the outer surface 30*b* of the connector housing 30 and closely contacts with the outer surface 30*b*. The sealing member 50 is supported by the second facing wall surface 22*bb* from outside in the radial direction. In other words, the second facing wall surface 22*bb* restricts bulging of the sealing member 50 radially outward of the recess 22*b*. Such restriction can increase a degree of bulging of the sealing member 50 radially inward (toward the outer surface 30*b*).

In the present embodiment, the shielding shell 20, the connector housing 30, and the outer housing 60 are integrally formed by insert molding. In insert molding, resin is injected into a mold containing the shielding shell 20 as an insert and the connector housing 30 and the outer housing 60 are molded. In this case, the injected resin shrinks as it is solidified in the mold, and this may create a gap between the shielding shell 20 (tube portion 21) and the connector housing 30. However, the sealing member 50 closely contacts with the outer surface 30*b* and this can prevent liquids from entering through the gap between the tube portion 21 and the connector housing 30 into a gap between the end portion 30*a* and the hole 10*b*.

With the single sealing member 50, the shielded connector 1 according to the embodiment can prevent liquids from entering the gap between the end portion 30*a* and the hole 10*b* through two entrance paths RE1 and RE2 of the liquids.

As another example different from the embodiment, a structure can be considered, in which the connector housing has a flange portion and the flange portion of the connector housing is disposed between the flange portion of the shielding shell and the sealing member. This structure can guide the liquids entering through a gap between the shielding shell and the connector housing to the outside of the sealing member. The sealing member provides a seal between the flange portion of the connector housing and a wall of a target object to which the shielded connector is fastened and prevents liquids from entering in the housing through the two entrance paths RE1 and RE2. However, providing the flange portion to the connector housing increases the size of the connector housing. Accordingly, additional material is needed for the flange portion and the weight increases. In the present embodiment, the sealing member 50 can prevent liquids from entering in a gap between the end portion 30*a* and the hole 10*b* through the two entrance paths RE1 and RE2 without providing such a flange portion to the connector housing 30. In other words, providing a single sealing member 50 can prevent liquids from entering through the two entrance paths RE1 and RE2 without increasing the size of the connector housing 30.

As illustrated in FIG. 4, the sealing member 50 has first protrusions P1 and a second protrusion P2. The first protrusions P1 of the sealing member 50 protrude toward the wall portion 10*a*. The first protrusions P1 are formed so as to surround the hole 10*b* in the wall portion 10*a*. In the present embodiment, the sealing member 50 has two first protrusions P1. One of the first protrusions P1 is formed so as to surround the hole 10*b* and the other one of the first protrusions P1 is formed so as to surround the first one. Providing the first protrusions P1 to the sealing member 50 allows the sealing member 50 to provide a tighter seal on the wall portion 10*a*.

The second protrusion P2 of the sealing member 50 protrudes toward the outer surface 30*b*. In the present embodiment, the sealing member 50 has one second protrusion P2. The second protrusion P2 is formed so as to surround the outer surface 30*b*. Providing the second protrusion P2 to the sealing member 50 allows the sealing member 50 to provide a tighter seal on the outer surface 30*b*.

The outer housing 60 is formed surround the tube portion 21. The outer housing 60 is a member to be fitted with a counterpart connector. The outer housing 60 has a retaining structure 61. The retaining structure 61 is provided to keep the shielded connector 1 completely fitted with the counterpart connector. The outer housing 60 has protrusions, or what is called beaks, as the retaining structure 61. Each protrusion of the retaining structure 61 has a locking surface 61*a* and a inclined surface 61*b*. The inclined surface 61*b* inclines from an outer surface of the outer housing 60 to an edge of the locking surface toward the wall portion 10*a*. The counterpart connector includes a retaining structure facing the retaining structure 61. The retaining structure of the counterpart connector passes over the inclined surface 61*b* and the shielded connector 1 and the counterpart connector are fitted. The locking surface 61*a* locks the retaining structure of the counterpart connector, thereby preventing disengagement of the counterpart connector from the shielded connector 1.

As described above, the shielded connector 1 according to the embodiment includes the shielding shell 20, the connector housing 30, and the sealing member 50. The shielding shell 20 has the tube portion 21 and the flange portion 22 formed at an end of the tube portion 21. The flange portion 22 is fastened to the wall portion 10*a* of a target object (housing 10) to which the shielded connector 1 is fastened. The wall portion 10*a* has the hole 10*b*. The connector housing 30 is covered with the tube portion 21. The connector housing 30 has the end portion 30*a* projecting in an axial direction beyond the flange portion 22 and inserted in the hole 10*b*. The sealing member 50 is an annular member sandwiched between the flange portion 22 and the wall portion 10*a*. The sealing member 50 closely contacts with the wall portion 10*a* by being compressed toward the wall portion 10*a* and closely contacts with the outer surface 30*b* by being compressed toward the outer surface 30*b* of the connector housing 30.

The sealing member 50 of the shielded connector 1 according to the embodiment closely contacts with the wall portion 10*a* by being compressed toward the wall portion 10*a* and closely contacts with the outer surface 30*b* by being compressed toward the outer surface 30*b* of the connector housing 30. The sealing member 50 can prevent liquids from reaching the hole 10*b* through the two entrance paths RE1 and RE2, a path between the flange portion 22 and the wall portion 10*a* and a path between the tube portion 21 and the connector housing 30, respectively. In other words, the single sealing member 50 can prevent liquids from reaching a gap between the connector housing 30 and the hole 10*b* through the two entrance paths RE1 and RE2. With this configuration, the shielded connector 1 can prevent liquids from entering from outside to a gap between the hole 10*b* of the housing 10 to which the shielded connector 1 is fastened and the end portion 30*a* of the connector housing 30 inserted in the hole 10*b* without increasing the size of the shielded connector 1.

The structure described above can reduce the number of parts compared to a structure including sealing members for the respective entrance paths RE1 and RE2 through which liquids enter. The smaller number of parts can reduce the size of the shielded connector 1. The smaller number of parts can also reduce the weight of the shielded connector 1.

In the shielded connector 1 according to the embodiment, the flange portion 22 is formed so as to surround the outer surface 30*b* of the connector housing 30 and has the annular recess 22*b* indented away from the wall portion 10*a*, and the sealing member 50 is disposed in the recess 22*b*.

Since the sealing member 50 can be disposed in the recess 22*b*, space for housing the sealing member 50 can be provided without processing the wall portion 10*a* of the housing 10.

In the shielded connector 1 according to the embodiment, the recess 22*b* has a facing wall surface (second facing wall surface 22*bb*) facing the outer surface 30*b* of the connector housing 30, and the sealing member 50 is supported by the facing wall surface (second facing wall surface 22*bb*) from outside in the radial direction.

The second facing wall surface 22*bb* restricts bulging of the sealing member 50 radially outward. Such restriction can increase a degree of bulging of the sealing member 50 radially inward (toward the outer surface 30*b*). This configuration enables the sealing member 50 to provide a tighter seal on the outer surface 30*b*.

In the embodiment above, the shielding shell 20, the connector housing 30, and the outer housing 60 are integrally formed by insert molding, but the embodiment is not limited to this. For example, separated shielding shell 20, connector housing 30, and outer housing 60 may be assembled into a unified part.

The shielded connector according to the present embodiment includes an annular sealing member sandwiched between a flange portion and a wall portion. The sealing member closely contacts with the wall portion by being compressed toward the wall portion and closely contacts with the outer surface by being compressed toward the outer surface of a connector housing. The shielded connector according to the present invention can prevent liquids from entering a gap between a hole of a target object to which the shielded connector is fastened and an end portion of the connector housing inserted in the hole without increasing the size of the shielded connector.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A shielded connector comprising:

a shielding shell having a tube portion and a flange portion formed at an end of the tube portion, the flange portion being fastened to a wall portion of a target object to which the shielded connector is fastened, the wall portion having a hole;

a connector housing covered with the tube portion, the connector housing having an end portion projecting in an axial direction beyond the flange portion, the end portion being inserted in the hole; and an annular sealing member sandwiched between the flange portion and the wall portion, wherein the connector housing includes an outer surface that opposes an inner surface of the annular sealing member in a radial direction of the sealing member, and the sealing member closely contacts with the wall portion by being compressed toward the wall portion and the inner surface of the sealing member closely contacts with the outer surface of the connector housing in the radially direction of the sealing member by being compressed toward the outer surface in the radial direction of the sealing member, the flange portion is formed so as to surround the outer surface of the connector housing and has an annular recess indented toward a direction away from the wall portion, and the sealing member is disposed in the recess, the flange portion at the recess has a facing wall surface facing the outer surface of the connector housing, the sealing member is supported by the facing wall surface from outside in a radial direction, the flange portion at the recess includes another facing wall surface facing the wall portion and extending from the facing wall surface to the tube portion, the sealing member contacts the another facing wall surface, the sealing member closely contacts with the outer surface of the connector housing at a location that is spaced away from the flange portion of the shield shell, and the shield shell is made from a conductive metal.

* * * * *